US006971929B2

(12) United States Patent
Safai et al.

(10) Patent No.: US 6,971,929 B2
(45) Date of Patent: Dec. 6, 2005

(54) MODULAR HIGH DENSITY CONNECTOR

(75) Inventors: Sohrab Safai, Laguna Niguel, CA (US); Carl Rodney Bunke, Riverside, CA (US); Chris Harold McDonald, Yorba Linda, CA (US); Rene Augusto Mosquera, Huntley, IL (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/816,350

(22) Filed: Mar. 31, 2004

(65) Prior Publication Data

US 2005/0221639 A1 Oct. 6, 2005

(51) Int. Cl.[7] ..... H01R 13/627
(52) U.S. Cl. ..... 439/862; 439/852
(58) Field of Search ..... 439/862, 865–868, 439/877, 851–852, 884

(56) References Cited

U.S. PATENT DOCUMENTS

| | | | | |
|---|---|---|---|---|
| 3,209,308 A | | 9/1965 | Aquillon | 339/176 |
| 3,611,270 A | | 10/1971 | Eppler | 339/176 |
| 4,306,761 A | * | 12/1981 | Ress, Jr. | 439/862 |
| 4,343,528 A | | 8/1982 | Lucius et al. | 339/198 |
| 5,230,635 A | | 7/1993 | Takenouchi et al. | 439/157 |
| 5,601,458 A | * | 2/1997 | Ohsumi et al. | 439/852 |
| 5,833,484 A | | 11/1998 | Post et al. | 439/352 |
| 5,888,081 A | | 3/1999 | Konoya et al. | 439/157 |
| 5,890,933 A | | 4/1999 | Okabe | 439/701 |
| 5,938,458 A | | 8/1999 | Krehbiel et al. | 439/157 |
| 6,017,250 A | | 1/2000 | Tsuji et al. | 439/701 |
| D434,375 S | * | 11/2000 | Kawamoto | D13/133 |
| 6,183,269 B1 | | 2/2001 | Sarkissian et al. | 439/76.1 |
| 6,200,174 B1 | * | 3/2001 | Katoh et al. | 439/862 |
| 6,217,354 B1 | | 4/2001 | Fencl et al. | 439/157 |
| 6,264,485 B1 | | 7/2001 | Saka et al. | 439/157 |
| 6,347,031 B1 | * | 2/2002 | Kawamoto | 361/212 |
| 6,461,177 B1 | | 10/2002 | Saka et al. | 439/157 |
| 6,488,516 B2 | | 12/2002 | Osawa et al. | 439/157 |

* cited by examiner

*Primary Examiner*—Michael C. Zarroli
(74) *Attorney, Agent, or Firm*—Peter Van Winkle

(57) ABSTRACT

A connector includes sheet metal contacts (40, 42) with termination ends (60, 62) for terminating to wires and with mating ends (70, 72) for mating to other contact devices such as circuit board pads. Each terminating end includes a wide groove part (90) with a groove bottom (94) that receives the wire insulation and with a pair of wide groove part wings (96, 98) that are crimped around the insulation. Each termination end also includes a narrow groove part (100) for receiving a bared conductor of the wire, the narrow groove part having a bottom (104) that is offset from the wide groove part bottom (94), and the narrow groove part having a pair of narrow groove part wings (106, 108) that are crimped around the wire conductor.

4 Claims, 5 Drawing Sheets

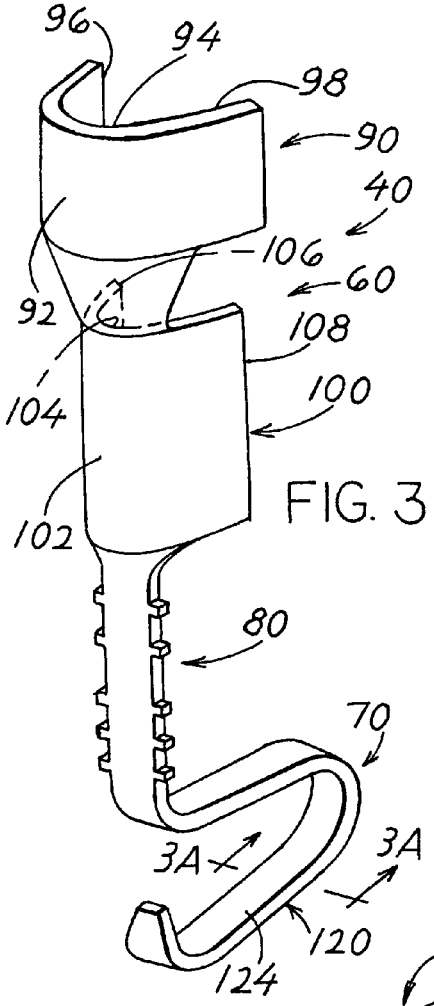
FIG. 3
FIG. 4
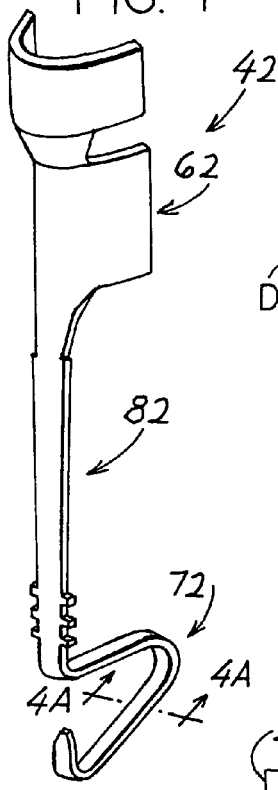
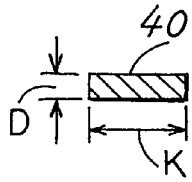
FIG. 3A
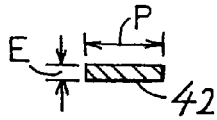
FIG. 4A
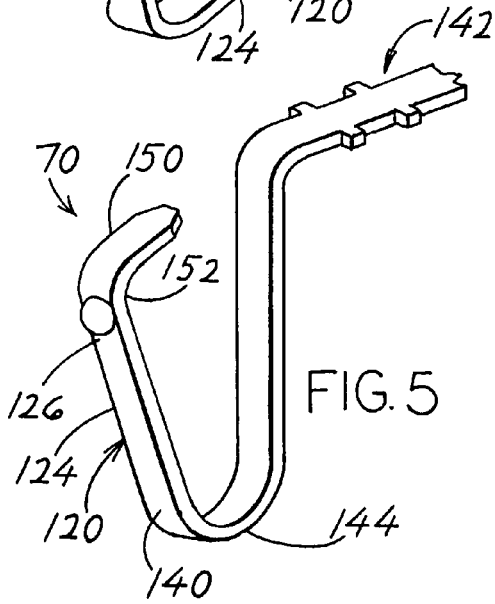
FIG. 5
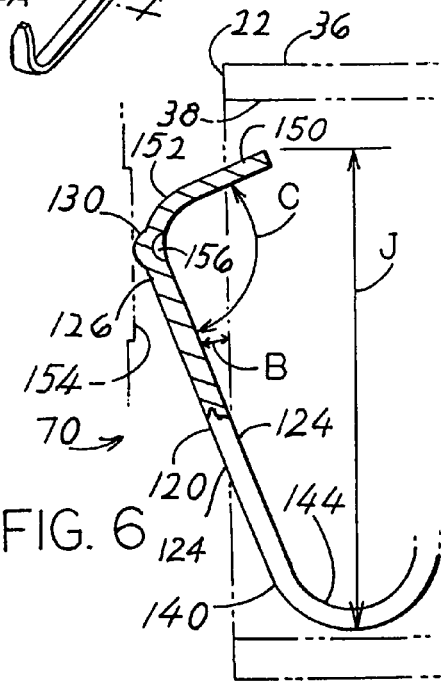
FIG. 6

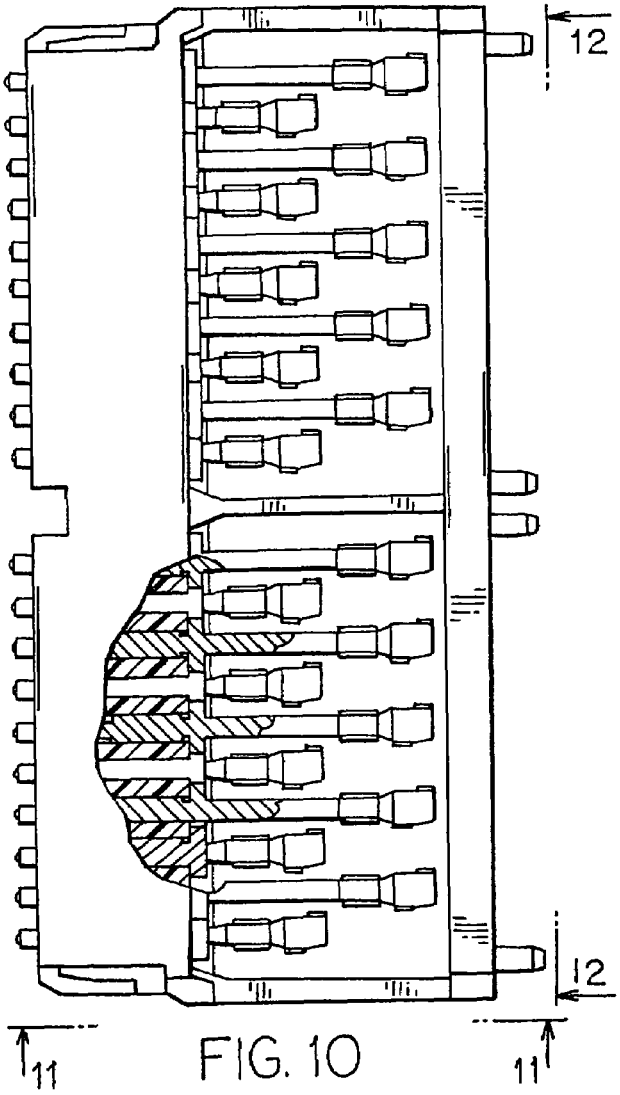
FIG. 10
FIG. 11
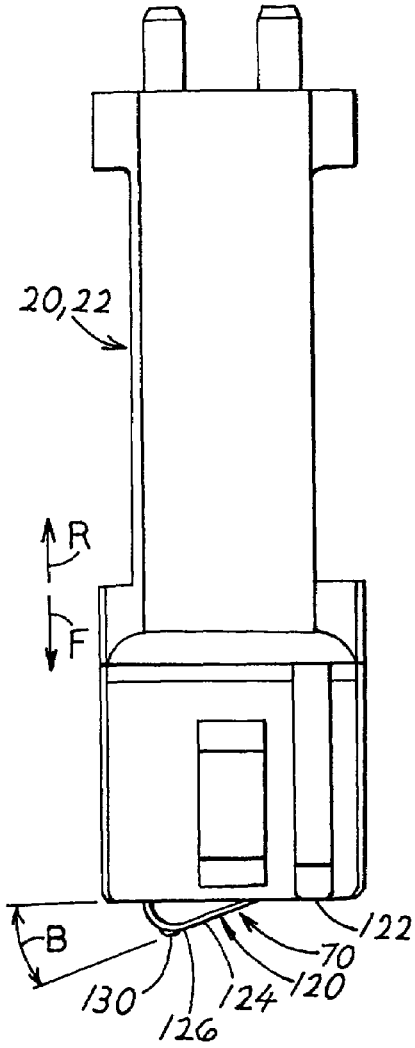
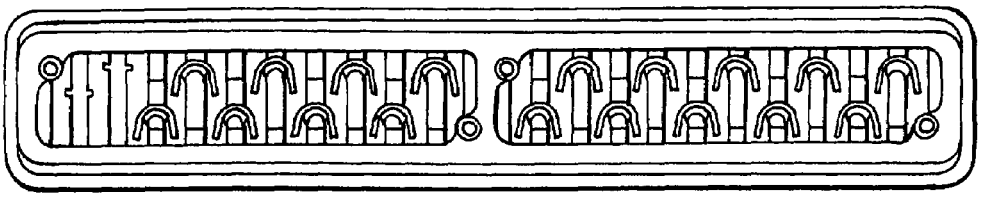
FIG. 12

MODULAR HIGH DENSITY CONNECTOR

BACKGROUND OF THE INVENTION

One type of electrical connector, shown in U.S. Pat. No. 6,183,269, includes a frame with passages that each holds a sheet metal contact, each contact having a mating end forming a resilient end beam that projects at an incline from a front face of the frame. The end beam is deflected back into the passage when the beam presses against a mating device such as a flat pad on a circuit board. It would be desirable if the end beam produced very low resistance contact, even when pressed with a small force against the pad. A termination end of the contact, which lies opposite the mating end, may have to be terminated to a wire. It would be desirable if a connector that holds a large number of such contacts, could terminate reliably and quickly to a large number of wires.

SUMMARY OF THE INVENTION

In accordance with one embodiment of the present invention, a connector is provided that includes a frame with contact-holding passages and contacts lying in the passages, each contact having a termination end for terminating to a wire and an opposite mating and for engaging a mating device such as a circuit board pad, wherein each contact can be made at low cost, can be easily terminated to a wire, and provides low resistance engagement with the mating device. Each contact is formed of sheet metal. The termination end of a contact has a wide groove part that receives a wire insulation, the wide groove part having a pair of wide wings that can be crimped around the insulation. The termination end also has a narrow groove part that receives the bared conductor of the wire and that has narrow wings that can be crimped around the conductor. The bottom of the narrow groove part is offset from the bottom of the wide groove part.

The mating end of a contact has a resilient end beam with an inner end connected by an inner bend to a main contact portion. The end beam has a primarily straight middle extending at an incline to the front face of the frame, and the end beam has a beam free outer portion connected by an outer bend to the beam middle. The outer bend forms an angle of less than 135°, as measured at the inside of the bend, and the free outer portion preferably extends back into the passage. Concentrated pressure is increased by forming a spherical protrusion at the outer end of the beam middle.

The novel features of the invention are set forth with particularity in the appended claims. The invention will be best understood from the following description when read in conjunction with the accompanying drawings.

BRIEF DESCRIPTION OF THE DRAWINGS

FIG. 3 is an isometric view of a large contact of a connector of FIG. 1.

FIG. 3A is a sectional view taken on line 3A—3A of FIG. 3.

FIG. 4 is an isometric view of a small contact of a connector of FIG. 1.

FIG. 4A is a sectional view taken on line 4A—4A of FIG. 4.

FIG. 5 is an isometric view of a portion of the contact of FIG. 3.

FIG. 6 is a sectional side view of a portion of the contact of FIG. 5.

FIG. 10 is a partially sectional plan view of the connector of FIG. 2.

FIG. 11 is an enlarged side view taken on line 11—11 of FIG. 10.

FIG. 12 is an end view taken on line 12—12 of FIG. 10.

DESCRIPTION OF THE PREFERRED EMBODIMENT

Figure 1:
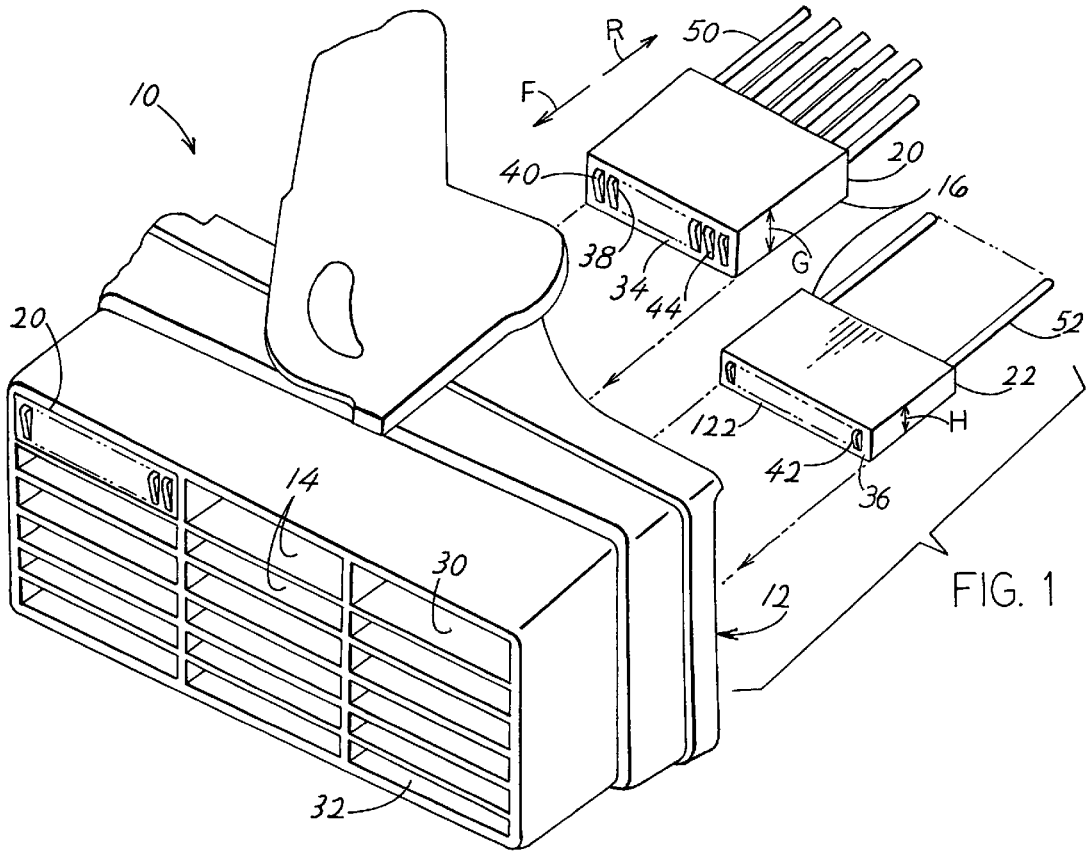
FIG. 1 is an exploded isometric view of a connector system of the present invention.

FIG. 1 shows a connector system 10 which includes a housing 12 having a plurality of tunnels 14 that each can receive a connector 16. The system includes large connectors 20 that are used for transmitting power, and small connectors 22 that are used for transmitting signals. The large connectors 20 lie closely (occupy at least 90% of the cross-section) in large tunnels 30 of the housing, while the small connectors 22 lie closely in small tunnels 32 of the housing. Each connector has a frame 34, 36 with contact-holding passages 38 that hold contacts, there being large contacts 40 in the large connectors and small contacts 42 in the small connectors. Each passage is elongated in a longitudinal direction L. Each of the contacts has a projecting portion 44 that engages a mating device, such as a pad on a circuit board, and each contact is connected to a wire 50, 52. The large number of contacts that must be terminated to a corresponding large number of wires, makes it important that each contact be constructed at low-cost and be easily terminated to a wire.

FIGS. 3 and 4 respectively show large and small contacts 40, 42. The two contacts are very similar, each having a termination end 60, 62, a mating end 70, 72, and a middle 80, 82. The termination end of the large contact has a wide groove part 90 with a wide groove middle 92 having a groove bottom 94 that receives insulation of a wire. A pair of wide groove part wings 96, 98 initially extend in a spread apart pattern and project from opposite sides of the middle 92. The termination end also has a narrow groove part 100 with a narrow groove middle 102 having a groove bottom 104 that receives the bared conductor of the wire. A pair of narrow groove part wings 106, 108 spread apart and project from opposite sides of the narrow groove middle.

Figure 7:
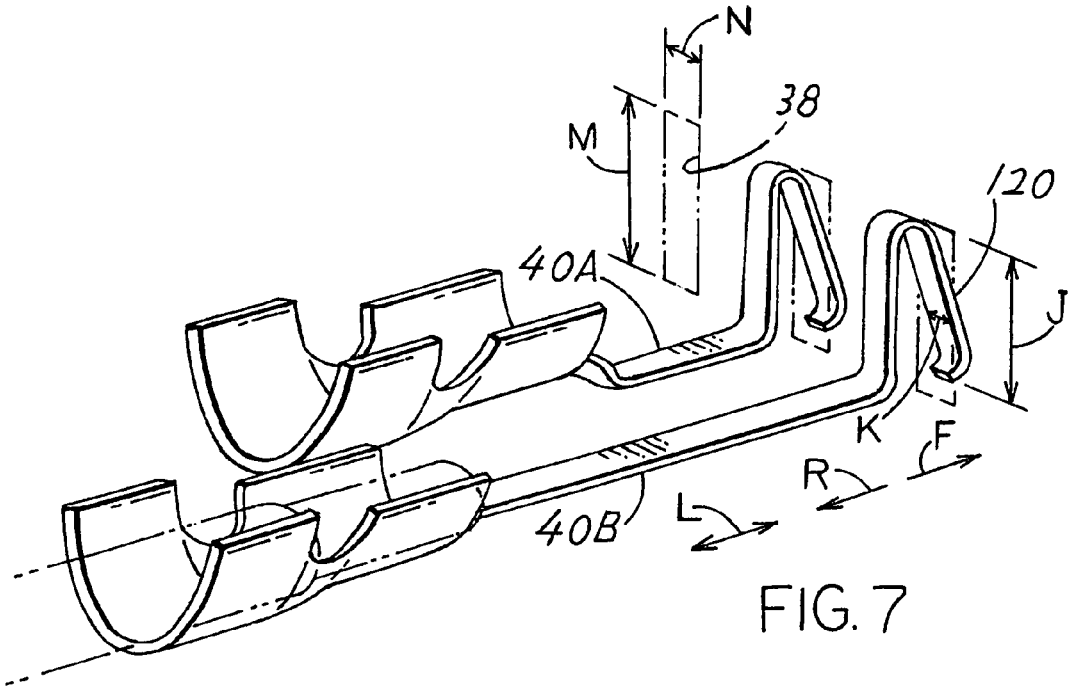
FIG. 7 is an isometric view of two adjacent contacts of the same connector, showing in phantom lines, a wire laid in the termination end of one contact but prior to crimping.
Figure 9:
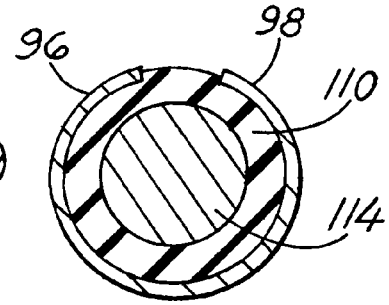
FIG. 9 is a sectional view taken on line 9—9 of FIG. 8.
Figure 8:
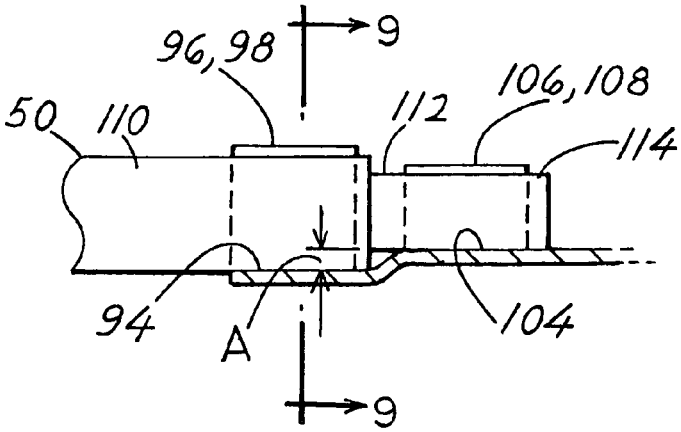
FIG. 8 is a partial sectional view of one of the connectors of FIG. 7, showing it crimped to a wire.

FIG. 8 shows a wire 50 with the insulation 110 lying in the wide groove part bottom 94 and with the bared end 112 of the conductor 114 lying in the narrow groove part bottom 104. There is an offset A between the groove bottoms 94, 104, the offset A being equal to one half the difference in outside diameters of the wire insulation 110 and of the wire conductor 114. After the wire has been laid in place, the wide part wings 96, 98 are crimped around the insulation, and the narrow part wings 106, 108 are crimped around the bared conductor, to complete the termination of the wires to the contacts. FIG. 7 shows that alternate contacts 40A, 40B have their termination ends lying at different heights and not aligned laterally but spaced longitudinally L, which facilitates crimping despite a small pitch (center-to-center lateral distance) of the contacts. The figure shows that the contacts are elongated in the longitudinal direction.

As shown in FIG. 11, the mating end 70 of each contact includes an end beam 120 that projects forward of the front end face 122 of the frame. The frame face extends perpendicular to the direction L of elongation of the contact passages. The end beam has a beam middle 124 that extends at an initial incline angle B of about 200 from the plane of the frame front face 122. An outer end 126 of the beam middle actually engages a circuit board pad or other mating contact device when the connector 20 or 22 is pressed forward F towards the pad. Applicant provides a bump 130 at the outer end of the beam middle to provide more concentrated force against the mating contact device. The radius of curvature of the convex side of the bump is no more than four times the sheet metal thickness.

FIGS. 5 and 6 show details of the contact mating portion 70. The beam middle 120 is straight, in that any radius of curvature is at least twice the length of the beam middle. The beam middle has an inner end 140 connected to a main contact portion 142 by an inner bend 144. At the outer end 126 of the beam middle, the beam middle connects to a beam free outer part 150 by an outer bend 152. The outer bend forms an angle C less than 135° as measured at the inside of the bend. In the prior art, a bend of a few degrees less than 180° was used. The bend allows the free outer part to project back into the frame passage 38, where it is protected from damage. Applicant prefers to provide a largely spherical bump 130 on the outer end 126 of the beam middle. This results in greater pressure against a mating device, such as a conductive pad 154 on a circuit board. The bump is convexly curved about two axes that both extend parallel to the plane of the frame end face 22. This can be done by outwardly bending the sheet metal of the contact, as shown in FIG. 6, which creates a recess 156.

FIGS. 3A and 4A show cross sections of the large contact 40 that is used to carry power currents and of the small contact 42 that is used to carry signals (which have small currents). Both contacts are formed of sheet metal, but with the sheet metal of the large contact having a thickness D that is usually at least 150% of the thickness E of the sheet-metal of the small contact 42. The large contact also usually has a somewhat larger width K than the small contact width P. The stiffness of a beam increases with the third power of its thickness, so the end beam of the large contact 40 tends to be stiffer because of its large thickness D. To increase the resilience of the end beam of the large contact, applicant increases the height J (FIG. 6) of the end beam of the large power contact so it is at least 150% of the height of the beam of the small signal contact. As shown in FIG. 1, this results in the thickness G of the large connector being greater than the thickness H of the small connector. In a connector that applicant has designed, the large contact 40 was formed of sheet metal having a thickness D (FIG. 3A) of 20 mils (one mil equals one thousandth inch) while the small contact 42 had a thickness E of 10 mils. As shown in FIG. 7, each end beam has a height J that is a plurality of times its width K, and each passage 38 has a height M that is a plurality of times its width N.

Figure 2:
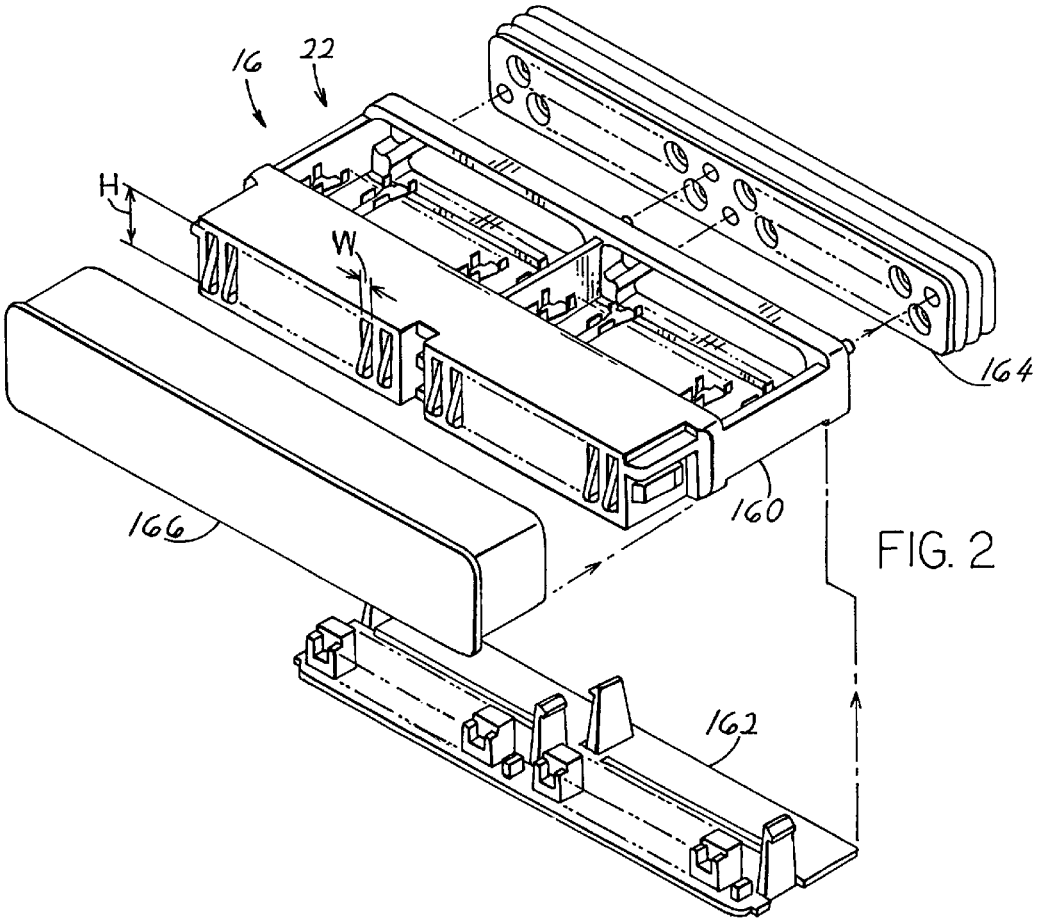
FIG. 2 is an exploded isometric view showing one of the connectors of the system of FIG. 1 and showing a protective cap and a grommet that is used with the connector.

As shown in FIG. 2, each connector such as 22 includes an insulator 160 and a retention plate 162 that is snapped to the insulator. A grommet 164 seals to the wires that are terminated to contacts in the insulator. An end cap 166 protects the contact end beams during shipping.

Thus, the invention provides a connector with multiple contacts that can be constructed at low cost, that can be easily terminated to wires in reliable connections, and that provide high pressure contacts with mating devices such as circuit board pads with only moderate forces pushing the connector against the pads. The termination end of each contact has wide and narrow groove parts with offset bottoms that receive the insulation and bared conductor of a wire, each groove part having wings that crimp to the insulation or conductor. The mating end of each contact has an end beam with a beam middle, the beam middle having an inner end connected by an inner bend to the rest of the contact and the beam middle having an outer end connected by an outer bend to a free beam outer part. The outer bend has an angle of less than 135° at the inside of the bend, so that the beam outer part can extend back into the frame passage. A largely spherical bump can be placed at the outer end of the beam middle to provide concentrated force against a mating device.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector that includes a frame having a through passage and a frame front face that extends perpendicular to a longitudinal direction (L), the connector including a contact lying in the passage, said contact being formed of a piece of sheet metal, said contact having a main contact portion that is elongated in said longitudinal direction and having a mating end portion that comprises a resilient end beam with a beam middle inner end connected by an inner bend to said main contact portion, with a beam middle extending from said beam middle inner end at an incline and forward of said frame face and a beam free outer portion lying forward of said frame face and extending from an outer end of said beam middle that is opposite said beam inner end, wherein:

said beam middle extends straight and at an angle (B) of about 20° to said frame face and extends beyond said frame front face, and said beam free outer portion extends from an outer end of said beam middle that is opposite said beam middle inner end, in a bend that results in said free outer portion extending from beyond said frame front face back into said frame passage.

2. A connector that includes a plurality of frames that each has a contact-holding passage, a contact lying in said passage, and a wire that has a conductor and a wire insulator lying around the conductor except at a bared conductor end, each contact being formed of a single piece of sheet metal and having a contact termination end that is terminated to the wire, a contact mating end for contacting to a mating contact device, and a contact middle mounted in the frame, wherein:

said termination end of each contact includes a wide groove part with a wide groove middle that has a wide groove bottom that receives the insulation, said wide groove part including a pair of wide groove part wings projecting from the wide groove part middle and crimped around the wire insulation;

said termination end of each contact also includes a narrow groove part having a narrow groove middle that has a narrow groove bottom that is offset from said wide groove bottom, said narrow groove bottom receiving the bared conductor, said narrow groove part having a pair of narrow groove part wings projecting from the narrow groove part middle and crimped around the bare conductor, and including;

a housing that has a plurality of tunnels including a small tunnel and a large tunnel, the large tunnel having a larger cross-section than the small tunnel;

said plurality of frame devices includes a small frame that fits closely in said small tunnel end a large frame that fits closely in said large tunnel but not said small tunnel, each frame device having a frame front face;

each of said frame devices has front and rear ends and a plurality of passages extending between said ends, said passages each having a height that is a plurality of times as great as its width;

said contacts each lies in one of said passages, said multiplicity of contacts includes a plurality of small contacts each lying in one of said small passages and a plurality of large contacts each lying in one of said large passages;

each of said contacts has a contact major portion and has a resilient end beam with a beam inner end connected by an inner bend to the contact major portion and each end beam extending from its inner bend and having an outer portion extending at an incline away from the frame face the end beams of said large contacts have a cross-section that is at least 150% as large as the end beams of said small contacts, whereby the large contacts can be power contacts that carry large currents with minimal heating while the small contacts carry low current signals.

3. The connector described in claim 2 wherein:

each of end beams has an outer end that forms a contact location, and said large contacts each has a thickness along its end beam that is at least 150% of the thickness of said small contacts along their end beams, each end beam having a width that is greater than its thickness.

4. The connector described in claim 3 wherein:

each of said large passages has a greater height than said small passages, and each of said large contacts has an end beam of greater height than the height of the end beams of said small contacts.

* * * * *